US008276771B2

(12) United States Patent
Schuetz et al.

(10) Patent No.: US 8,276,771 B2
(45) Date of Patent: Oct. 2, 2012

(54) FLOAT RACK

(75) Inventors: Robert J Schuetz, Dallas, TX (US); Richard C Young, Dallas, TX (US)

(73) Assignee: RJ Schuetz Associates, LP, Dallas, TX (US)

( * ) Notice: Subject to any disclaimer, the term of this patent is extended or adjusted under 35 U.S.C. 154(b) by 230 days.

(21) Appl. No.: 12/561,183

(22) Filed: Sep. 16, 2009

(65) Prior Publication Data

US 2010/0065521 A1 Mar. 18, 2010

Related U.S. Application Data

(60) Provisional application No. 61/192,273, filed on Sep. 17, 2008.

(51) Int. Cl.
*A47F 5/08* (2006.01)

(52) U.S. Cl. ..... 211/95; 211/88.04; 211/123

(58) Field of Classification Search ..... 211/87.01, 211/86.01, 88.04, 95, 96, 99, 100, 45, 85.5, 211/16, 101, 102, 197, 172, 171, 173, 174, 211/119.004, 119.009, 182, 123; 248/309.2, 248/339–341, 476, 324, 919–923
See application file for complete search history.

(56) References Cited

U.S. PATENT DOCUMENTS 284,090 A * 8/1883 Tingle ..... 211/75
496,173 A * 4/1893 Smith ..... 211/75
1,087,450 A * 2/1914 Knox ..... 211/88.04
1,345,170 A * 6/1920 Gross ..... 211/105.2
2,485,201 A * 10/1949 Jewett ..... 211/96
2,595,521 A * 5/1952 Hanson ..... 211/119.004
2,647,643 A * 8/1953 Cruikshank ..... 211/100
3,346,229 A * 10/1967 Carson, Jr. ..... 248/477
3,635,352 A * 1/1972 Brooks et al. ..... 211/47
3,730,612 A * 5/1973 Arroyo et al. ..... 359/860
4,359,138 A * 11/1982 Kummerlin et al. ..... 182/214
4,541,535 A * 9/1985 Bartholomew ..... 211/96
4,724,966 A * 2/1988 Benaksas ..... 211/85.1
4,856,661 A * 8/1989 Guillen et al. ..... 211/100
4,932,498 A * 6/1990 Miller ..... 182/214
5,236,095 A * 8/1993 Krizka ..... 211/96
5,261,529 A * 11/1993 Holland ..... 206/6.1
5,535,896 A * 7/1996 Morgan, Sr. ..... 211/96
5,690,239 A * 11/1997 Ballard ..... 211/189
D424,345 S * 5/2000 Duggan ..... D6/523
6,216,882 B1 * 4/2001 Strunck et al. ..... 211/18
6,234,436 B1 * 5/2001 Kump ..... 248/220.21
D453,645 S * 2/2002 Jones ..... D6/523
6,386,407 B1 * 5/2002 Erickson et al. ..... 224/282
6,390,308 B1 * 5/2002 Ebrahim ..... 211/85.3
D509,905 S * 9/2005 Baker ..... D25/38.1
6,983,853 B1 * 1/2006 Fickett ..... 211/18
7,083,055 B1 * 8/2006 Ambrosat ..... 211/85.7
7,124,451 B2 * 10/2006 Moore ..... 4/576.1
7,445,191 B2 * 11/2008 Courbon ..... 248/479

(Continued)

*Primary Examiner* — Darnell Jayne
*Assistant Examiner* — Devin Barnett
(74) *Attorney, Agent, or Firm* — Shannon W. Bates; Klemchuk Kubasta LLP

(57) ABSTRACT

Embodiments of the present disclosure generally provide a rack for storing floats. A float rack may comprise a vertical support post, a plurality of slip-Ts and a plurality of float support arms. The vertical support post will typically have a top end and a bottom end. The slip-Ts are connected to the vertical support post to provide a rotating joint about the vertical support post. The float support arms are attached to the slip-Ts.

3 Claims, 8 Drawing Sheets

U.S. PATENT DOCUMENTS

| | | | | |
|---|---|---|---|---|
| 7,878,477 | B2 * | 2/2011 | Courbon | 248/478 |
| 2002/0158033 | A1 * | 10/2002 | Chen | 211/103 |
| 2003/0074857 | A1 * | 4/2003 | Clapp | 52/699 |
| 2003/0201139 | A1 * | 10/2003 | Haig | 182/107 |
| 2004/0255376 | A1 * | 12/2004 | Moore | 4/576.1 |
| 2007/0102383 | A1 * | 5/2007 | Evans et al. | 211/85.7 |
| 2009/0173704 | A1 * | 7/2009 | Kotajarvi | 211/88.04 |
| 2009/0266774 | A1 * | 10/2009 | Maclaren-Taylor | 211/45 |

* cited by examiner

FLOAT RACK

CROSS REFERENCE TO RELATED APPLICATION

This application claims benefit under 35 U.S.C. §119(e) of U.S. Provisional Patent Application Ser. No. 61/192,273 filed on Sep. 17, 2008 in the United States Patent and Trademark Office entitled "Hanging Float Rack." The entire disclosure of U.S. Provisional Patent Application Ser. No. 61/192,273 is incorporated by reference as if fully disclosed herein.

TECHNICAL FIELD

The disclosure relates generally to storage systems, and in particular to storage of floatation devices.

BACKGROUND

A standard closed foam float design includes a pillow formed by a loop in the foam material. Such floats are often difficult to store and cause clutter near pools, in garages, or on boats.

SUMMARY

Embodiments of the present disclosure generally provide a rack for storing floats. A float rack may comprise a vertical support post, a plurality of slip-Ts and a plurality of float support arms. The vertical support post will typically have a top end and a bottom end. The slip-Ts are connected to the vertical support post to provide a rotating joint about the vertical support post. The float support arms are attached to the slip-Ts.

Other technical features may be readily apparent to one skilled in the art from the following figures, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The present disclosure generally provides

Figure 1:
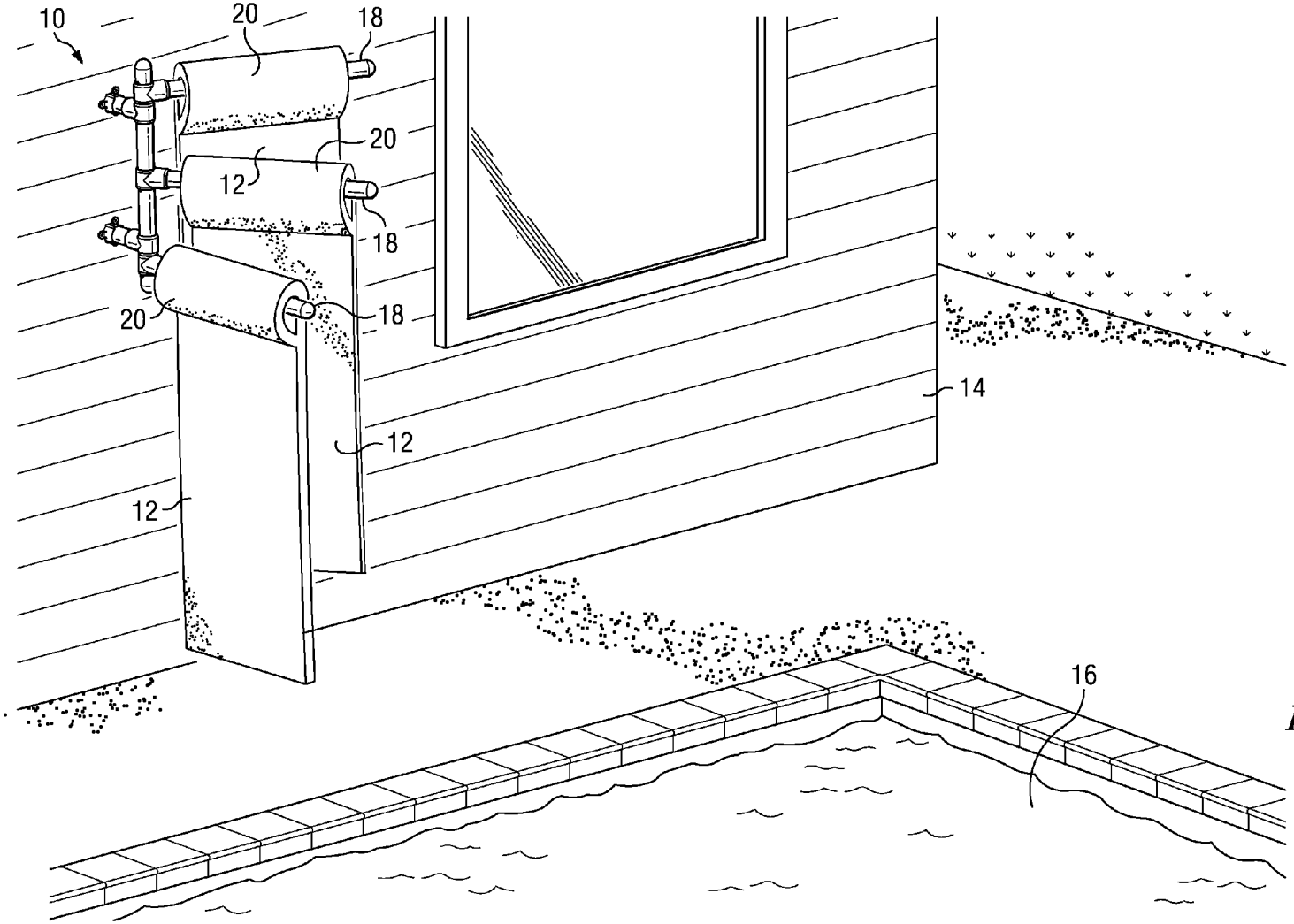
FIG. 1 is a view of a float rack installed to a building near a swimming pool.

FIG. 1 is a view of a float rack 10 with floats 12 installed on a building 14 near a swimming pool 16. Float rack 10 has three arms 18 sized to support floats 12 as shown. Float rack 10 is mounted to an outside wall of building 14 in the figure shown, but may be mounted inside, as in a garage or storage area. Floats 12 are common closed cell foam floats with a loop forming a headrest 20. Arms 18 are sized to fit within headrest 20 of float 12.

Figure 2:
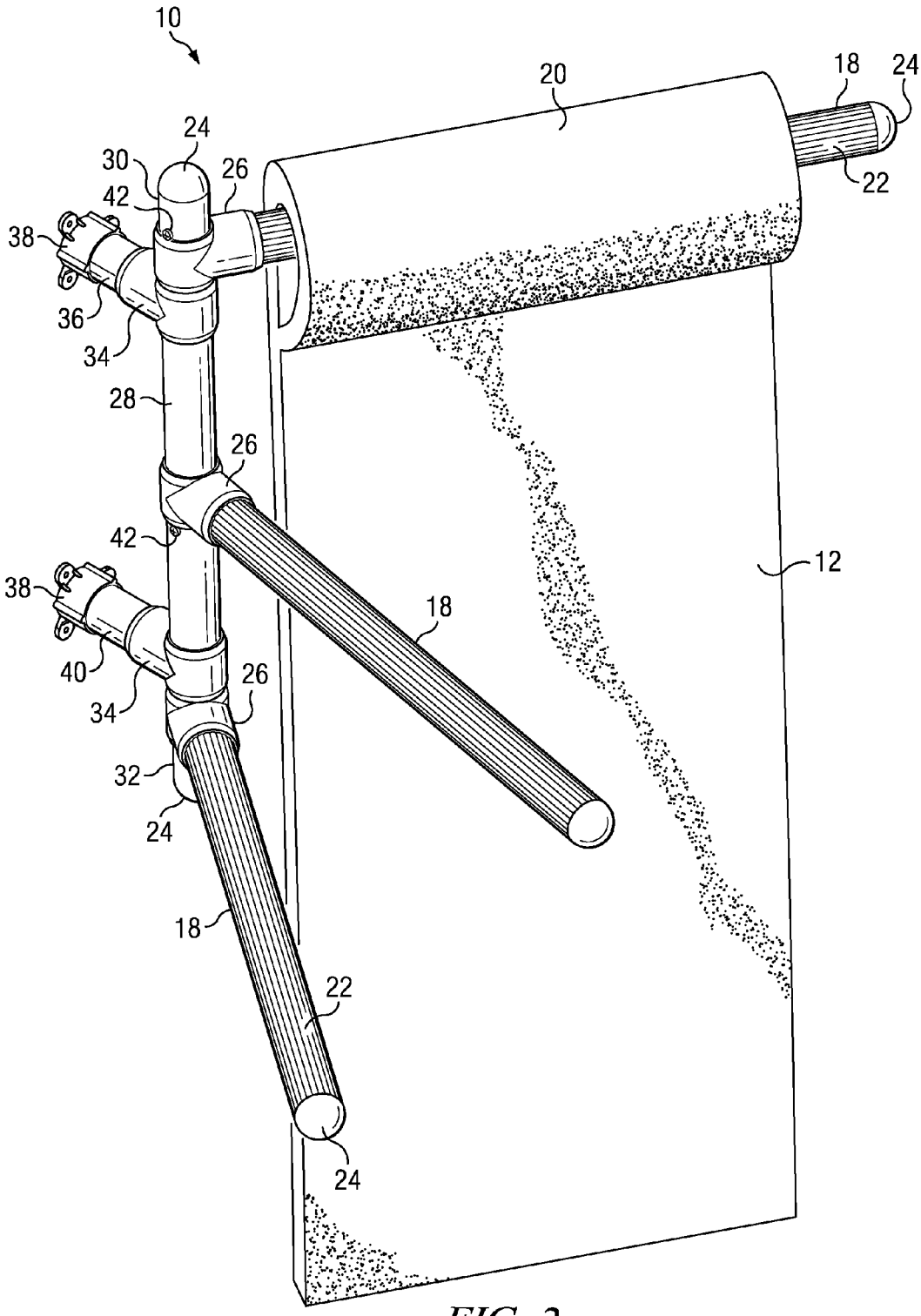
FIG. 2 is a close-up view of the float rack of FIG. 1 with a float.

FIG. 2 is a close-up view of the float rack 10 of FIG. 1 with a float 12 hanging by headrest 20 off of arm 18. Arm 18 is shown to have ribbing 22 in its outer surface. Ribbing 22 provides an improved aesthetic and allows for easy sliding of headrest 20 over arm 18. Arm 18 also has an end cap 24 to seal the arm 18 and provide for a smooth end. Arms 18 are attached to slip-Ts 26 which rotate about a vertical support post 28. Vertical support post 28 has an upper end 30 and a lower end 32, each having an end cap 24.

Near the upper end 30 of vertical support post 28 is a fixed-T 34 attached to upper support 36. A surface mount 38 is connected to the upper support 36 opposite the fixed-T 34. Near the lower end 32 of vertical support post 28 is another fixed-T 34 attached to a lower support 40. Another surface mount 38 is connected to the lower support 40 opposite the fixed-T 34. Lower support 40 is slightly longer than upper support 36 to allow arms 18 to be aligned on one side of vertical support post 28 with multiple floats 12.

Screws 42 are placed adjacent to slip-Ts 26 to prevent unwanted axial movement along vertical support post 28 while allowing rotation of slip-Ts 26 about vertical support post 28.

Figure 3:
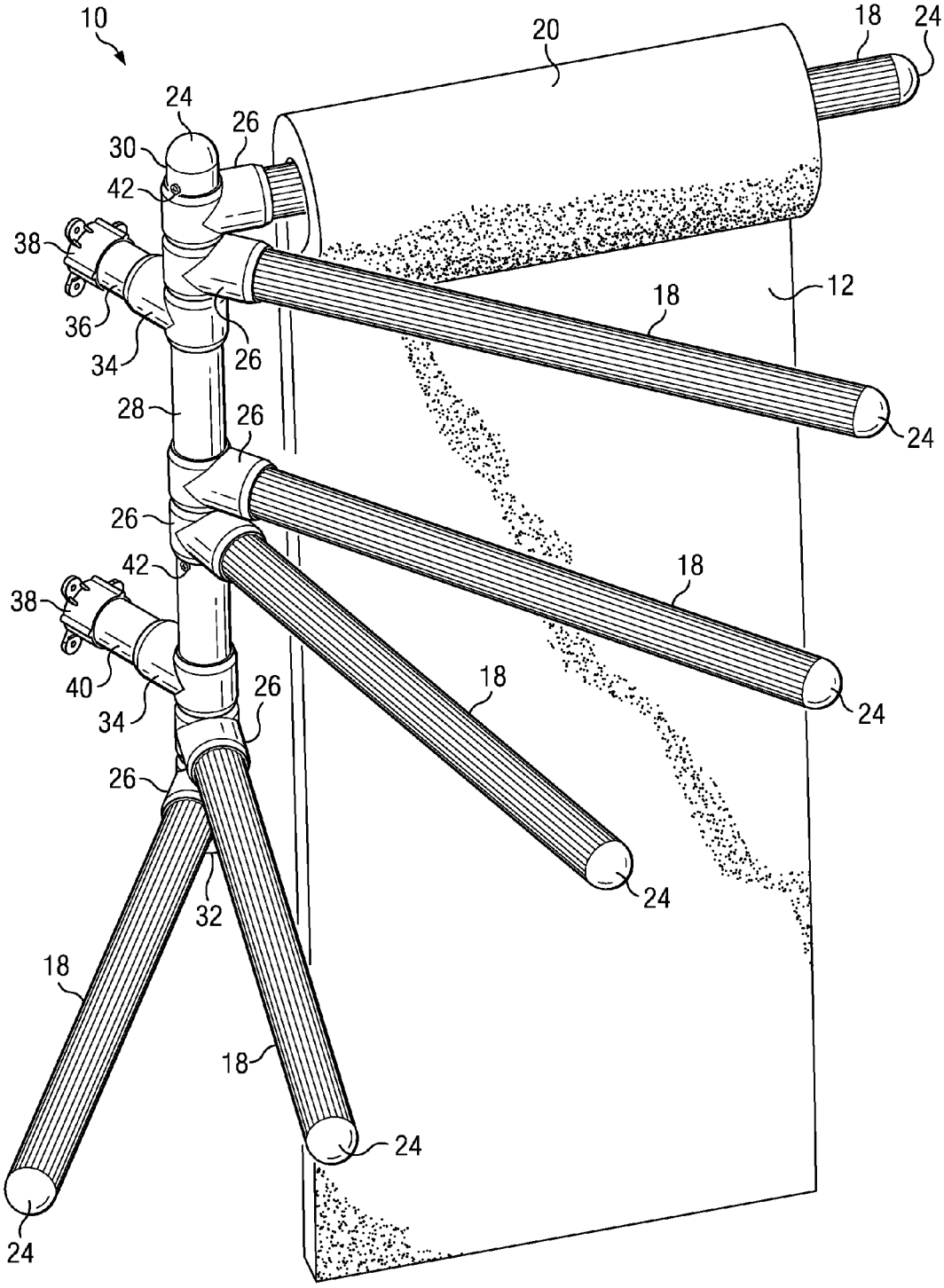
FIG. 3 is a close-up view of a float rack with a float.

FIG. 3 is a close-up view of a float rack with a float 12 and twice as many arms 12 as in FIGS. 1 and 2. Vertical support post 28 is elongated to allow for two slip-Ts 26 between the fixed-T 34 and the upper end 30 of vertical support post 28. A single screw 42 is still sufficient to restrain unwanted axial movement as slip-Ts 26 rotate against each other without interference. Likewise two slip-Ts 26 are positioned between the fixed-T 34 and the lower end 32 of vertical support post 28. Similarly two slip-Ts 26 are positioned near the middle of vertical support post 28 between fixed-Ts 34.

Again, lower support 40 is slightly longer than upper support 36 to allow three arms 18 to be aligned on each side of vertical support post 28 with multiple floats 12.

Figure 4:
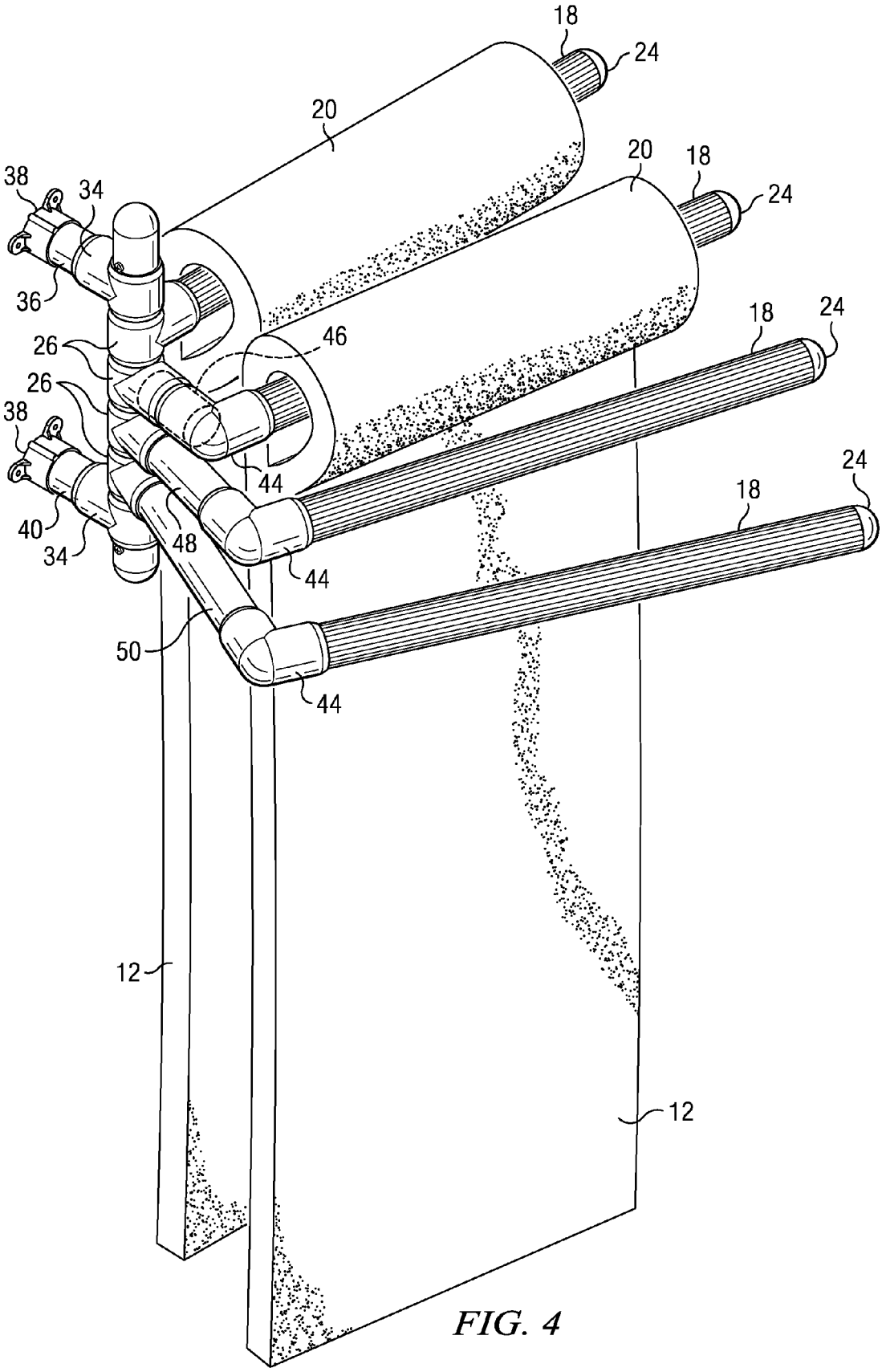
FIG. 4 is a close-up of a float rack with two floats.

FIG. 4 is a close-up of a float rack 10 with two floats 12 hanging by headrests 20. In this embodiment the slip-Ts 26 are arranged along vertical support post 28 between fixed-Ts 34. The uppermost arm 18 is similar to those discussed with regards to FIGS. 1, 2, and 3. The three lower arms 18 each have an elbow 44 on arm 18 and a spacing member 46, 48, 50 between the elbows 44 and the slip-Ts 26. The spacing element 46 is shorter than spacing element 48 which is in turn shorter than spacing element 50. Thus spacing elements 46, 48, 50 act to stagger arms 18 and provide space for floats 12. Thus upper support 36 and lower support 40 may be the same length.

Figure 5:
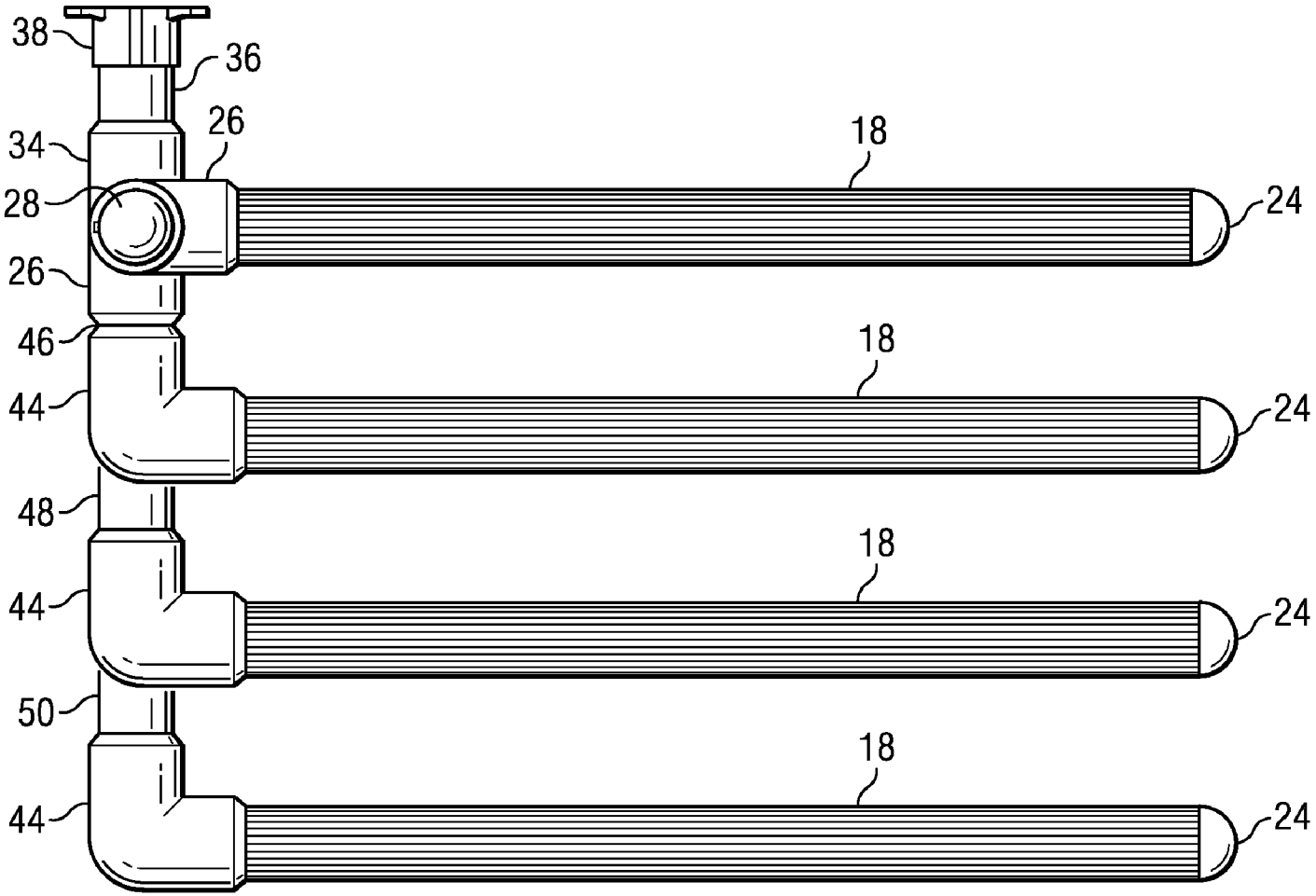
FIG. 5 is a top view of the float rack of FIG. 4.

FIG. 5 is a top view of the float rack 10 of FIG. 4 more clearly showing the different lengths of spacing elements 46, 48, 50 and the resultant spacing of arms 18.

Figures 6, 7:
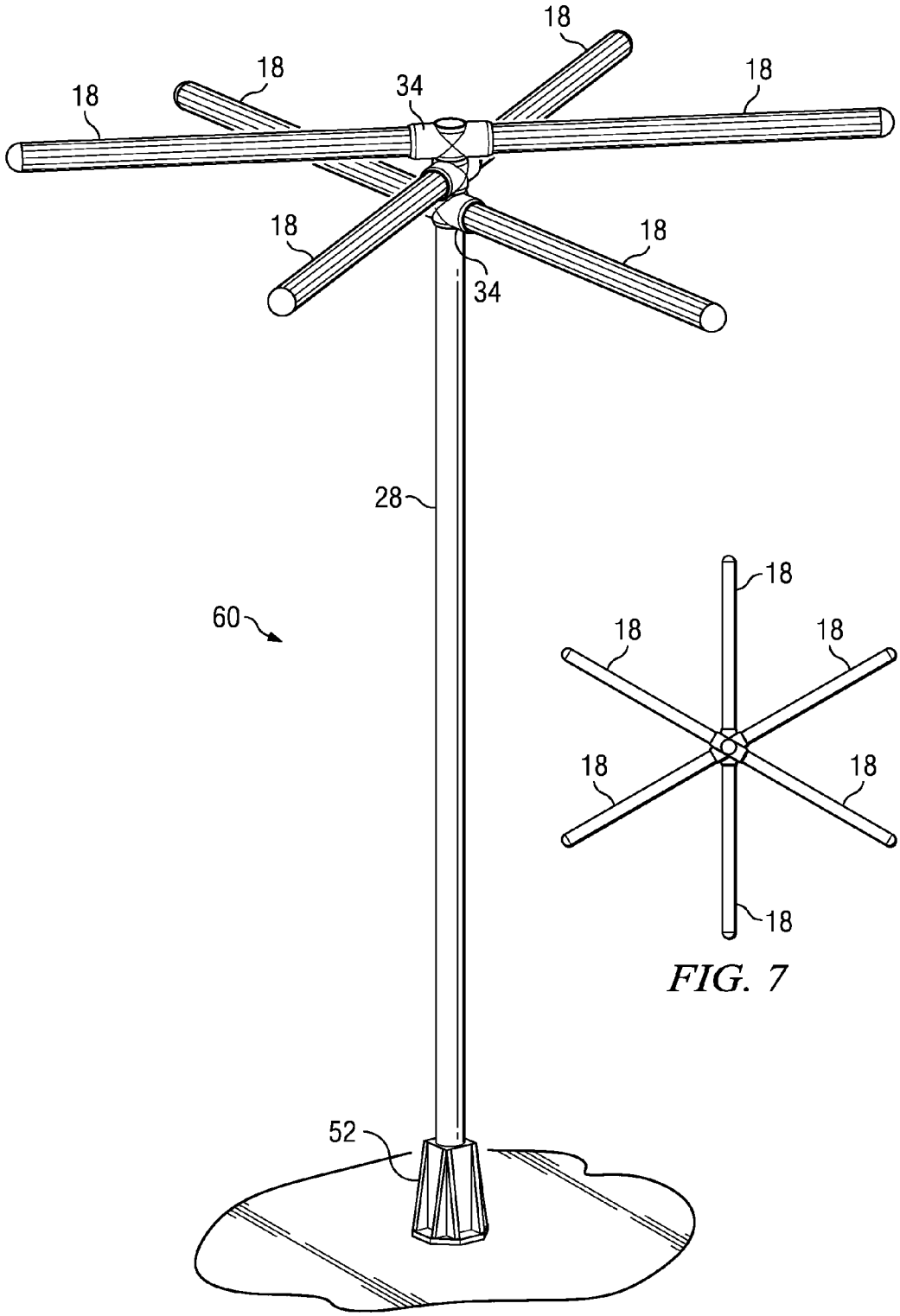
FIG. 6 is a view of a float rack.
FIG. 7 is a top view of the float rack in FIG. 6.

FIG. 6 is a view of a float rack 60 having a vertical support post 28 and three fixed-Ts 34 supporting pairs of arms 18 with end caps 24. The fixed-Ts 34 are arranged to provide an even distribution of arms 18 as shown in FIG. 7. Vertical support post 28 is secured in base 52.

FIG. 7 is a top view of the float rack 60 in FIG. 6 showing the arrangement of arms 18.

Figures 8, 9:
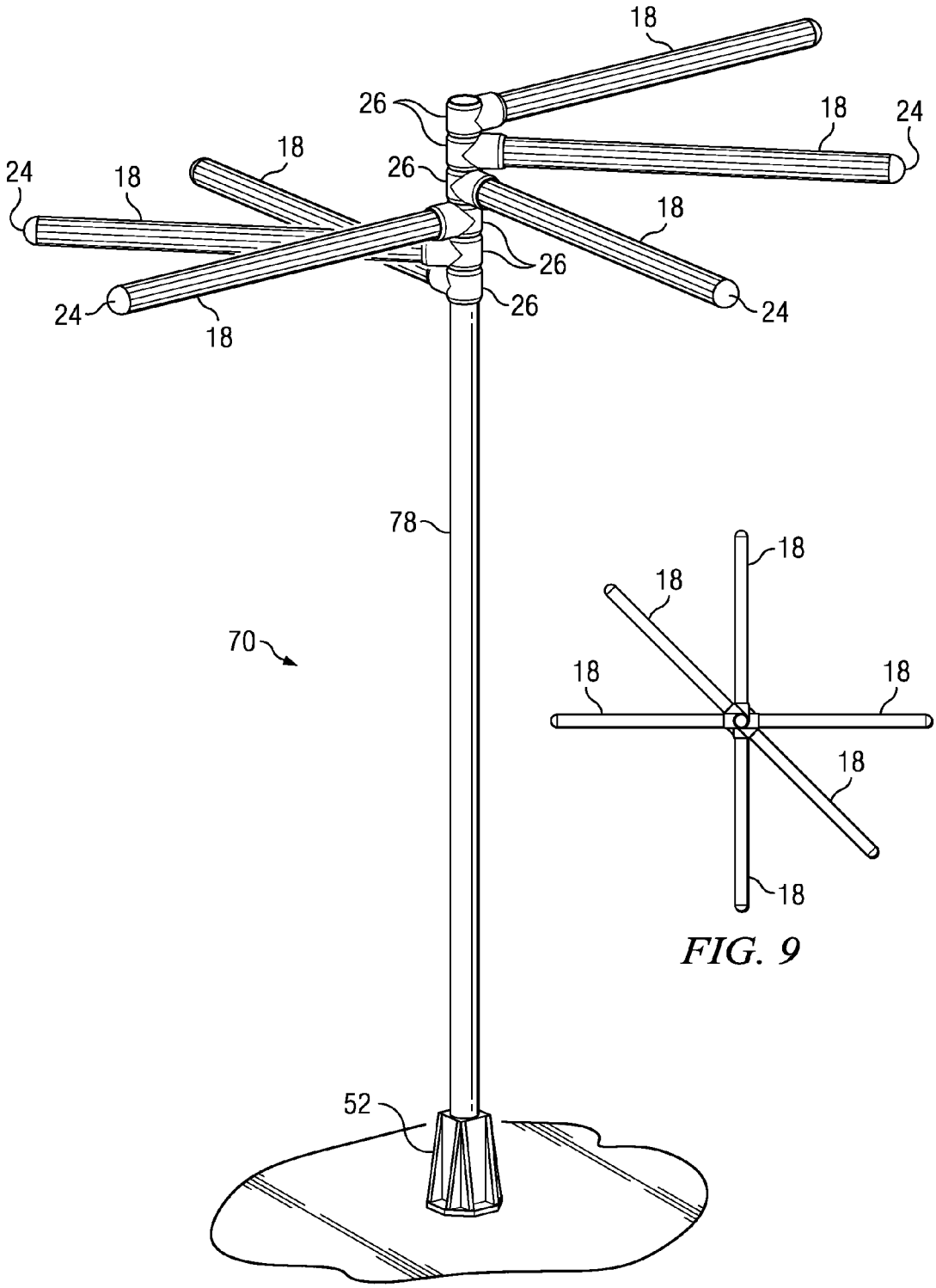
FIG. 8 is a view of a float rack.
FIG. 9 is a top view of the float rack in FIG. 8.
Figure 10:
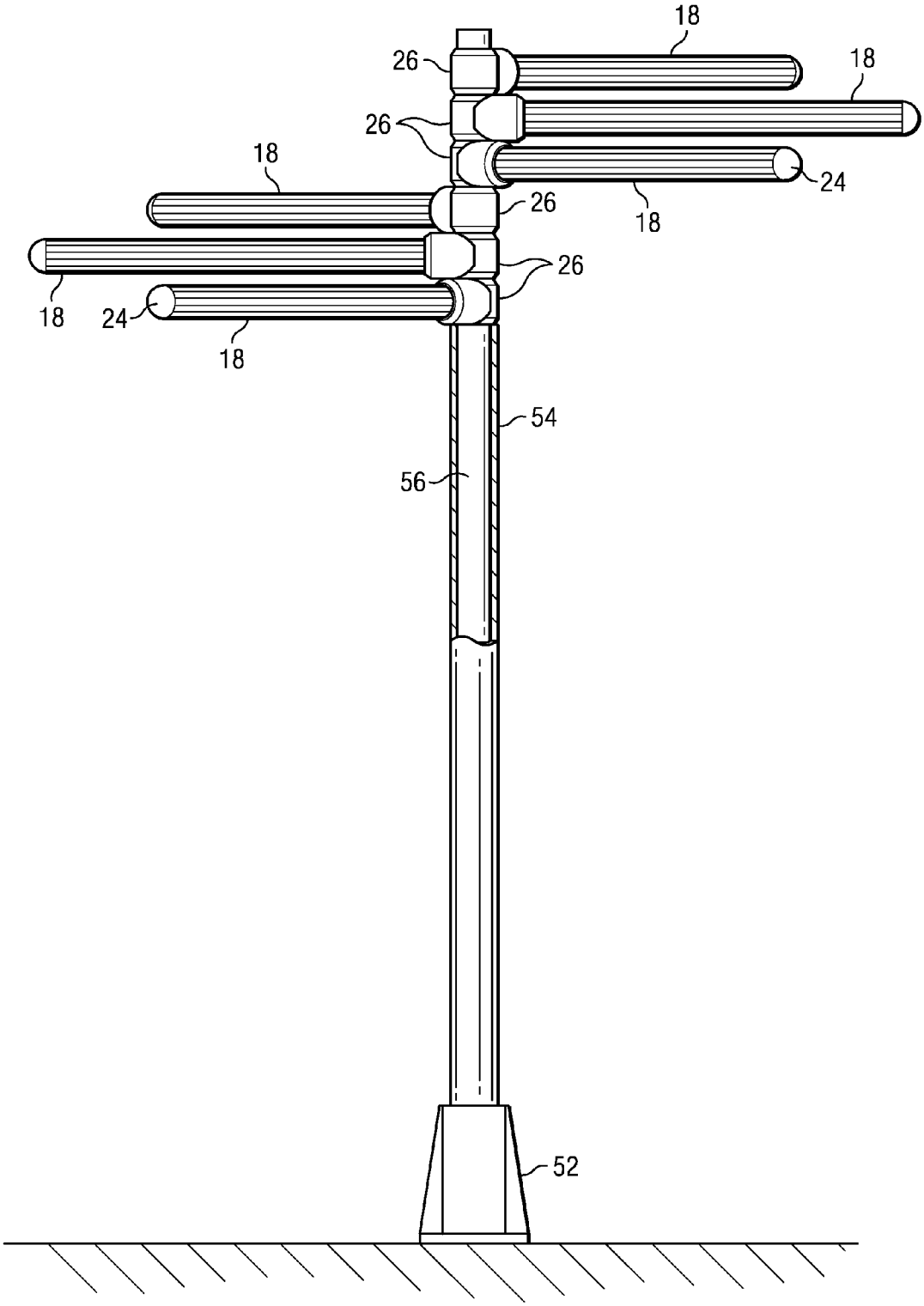
FIG. 10 is a sectional view of the float rack in FIG. 8.

FIG. 8 is a view of a float rack 70 having a vertical support post 78 and a base 52. Slip-Ts 26 support arms 18 with end caps 24. Support post 78 may be a composite support post made of an outer support post 54 and an inner support post 56, as shown in FIG. 10. In the alternative, vertical support post 78 may be a single element with a screw below the slip-Ts 26 from unwanted axially movement.

FIG. 9 is a top view of the float rack 70 in FIG. 8 showing that arms 18 may rotate independently about vertical support post 78.

FIG. 10 is a sectional view of the float rack 70 in FIG. 8 showing a composite version of vertical support post 78. The composite version of vertical support post 78 has an outer support post 54 extending from base 52 to the bottom of slip-Ts 26. Inner support post 56 extends from base 52 to the top of slip-Ts 26. Slip-Ts 26 are sized to fit about inner post 56 but not slide over outer post 54 such that the terminus of outer post 54 forms a shoulder to support slip-Ts 26. Inner post 56 runs the entire length of outer post 54 to provide additional rigidity to vertical support post 78.

All of the above embodiments, or parts thereof, may be made with a thermoplastic polymer to prevent corrosion and rusting. Polyvinyl chloride (PVC) is a suitable material for these embodiments and furniture grade PVC is useful where a thicker wall is desired. It is possible to obtain furniture grade PVC with a colorant treatment throughout the material to provide a more pleasant appearance and protection from fading, cracking, and brittleness. Where screws 40 are required they may be made of stainless steel to provide a non-corrosive alternative that has sufficient strength.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A float rack in combination with a plurality of floats each having a headrest comprising:

a vertical support post having a top end and a bottom end;

an upper support extending horizontally from the top end of the vertical support post, the upper support having a length;

a lower support extending horizontally from the bottom end of the vertical support post, the lower support having a length that is longer than the length of the upper support;

a plurality of slip-T joints connected to the vertical support post to provide a joint that rotates about the vertical support post;

a plurality of float support arms, each float support arm having a length and each float support arm being attached to one of the plurality of slip-T joints;

each float support arm comprising a ribbed material to allow easy sliding of the head rest over the float support arm;

an upper surface mount secured to the upper support;

a lower surface mount secured to the lower support;

wherein the upper surface mount and the lower surface mount fixedly secure the float rack to a supporting wall; and wherein the vertical support post is disposed at an angle with respect to the supporting wall when the float rack is secured to the supporting wall, the floats being aligned on the float support arms such that the floats lie substantially parallel to the supporting wall when stored.

2. The float rack of claim 1 wherein:

the vertical support post and float support arms are constructed of PVC pipe.

3. The float rack of claim 1 wherein:

the upper support and the lower support are each joined to the vertical support with a fixed-T joint.

* * * * *